US006543664B2

(12) United States Patent
Wolfberg

(10) Patent No.: US 6,543,664 B2
(45) Date of Patent: Apr. 8, 2003

(54) SELECTABLE TRIGGER

(75) Inventor: Robert L. Wolfberg, Buffalo Grove, IL (US)

(73) Assignee: Illinois Tool Works Inc, Glenview, IL (US)

( * ) Notice: Subject to any disclaimer, the term of this patent is extended or adjusted under 35 U.S.C. 154(b) by 54 days.

(21) Appl. No.: 09/810,638

(22) Filed: Mar. 16, 2001

(65) Prior Publication Data

US 2002/0130154 A1 Sep. 19, 2002

(51) Int. Cl.[7] ..... B27F 7/11
(52) U.S. Cl. ..... 227/8; 227/120; 227/131
(58) Field of Search ..... 227/8, 120, 130, 227/131, 147, 171

(56) References Cited

U.S. PATENT DOCUMENTS

| | | | | |
|---|---|---|---|---|
| 5,083,694 A | | 1/1992 | Lemos | |
| 5,551,620 A | | 9/1996 | Vallee | |
| 5,551,621 A | | 9/1996 | Vallee | |
| 5,662,257 A | * | 9/1997 | Mukoyama et al. | 227/130 |
| 5,687,897 A | | 11/1997 | Fa et al. | |
| 5,692,663 A | | 12/1997 | Yang | |
| 5,785,228 A | | 7/1998 | Fa et al. | |
| 5,791,545 A | | 8/1998 | Lin | |
| 5,797,533 A | | 8/1998 | Lee | |
| 5,836,501 A | | 11/1998 | Lai | |
| 5,862,969 A | | 1/1999 | Lee | |
| 6,059,161 A | | 5/2000 | Chang et al. | |
| 6,095,392 A | | 8/2000 | Batts, Jr. et al. | |
| 6,116,488 A | | 9/2000 | Lee | |
| 6,213,372 B1 | | 4/2001 | Chen | |

* cited by examiner

*Primary Examiner*—Scott A. Smith
*Assistant Examiner*—Nathaniel Chukwurah
(74) *Attorney, Agent, or Firm*—Lisa M. Soltis; Mark W. Croll; Donald I. Breh

(57) ABSTRACT

A trigger assembly for a power fastener driving tool having a housing, a control valve mounted to the housing and a reciprocating workpiece contacting element associated with the housing, includes a trigger member being pivotally engaged on the housing and having a pair of spaced walls, an actuation lever having a free end and a pivot end pivotally engaged on at least one of the walls, the free end being constructed and arranged for engaging the workpiece contacting element, and a biasing element for biasing the lever and the trigger away from the valve. At least one of the walls are configured for receiving the pivot end and for defining two positions for the lever, a first position which places the free end farther from the workpiece contacting element, and a second position which places the free end closer to the workpiece contacting element, and the lever being selectively positionable in either the first position or the second position and being held in the selected position by the biasing element.

12 Claims, 6 Drawing Sheets

SELECTABLE TRIGGER

BACKGROUND OF THE INVENTION

The present invention relates generally to powered fastener-driving tools, and particularly to trigger assemblies for such tools which operate between a sequential mode and a bottom trip or "bump fire" mode. Power fastener-driving tools are typically powered electrically, pneumatically, by combustion or powder activated. The present invention is contemplated as being suitable with any such tool, suitable examples of which are sold under the PASLODE brand manufactured by Illinois Tool Works, Vernon Hills, Ill.

Power fastener-driving tools of the type used to drive nails, staples and other types of fasteners typically include a housing, a power source, a supply of fasteners, a trigger for operating the power mechanism and a workpiece contacting element. The latter component is typically reciprocally slidable relative to the housing and connected to the trigger mechanism in some way, so that the fastener will not be driven unless the tool is pressed against a workpiece. An example of such a prior fastener-driving tool is disclosed in U.S. Pat. No. 4,629,106, which is incorporated by reference.

Power fastener-driving tools, whether pneumatic, electric or combustion powered, typically have two operational modes. The operator may select the desired operational mode by moving a lever or actuating a latch or switch. In a first such mode, known as a sequential or single shot mode, depression or squeezing of the trigger will not initiate the driving of a fastener ("a firing") without the workpiece contacting element being depressed in position against the workpiece. Similarly, upon the driving of the fastener, further depression of the trigger will not permit the driving of a subsequent fastener without the workpiece contacting element being in position. The sequential mode is typically employed in applications where greater care needs to be taken in driving each fastener, and the driving of multiple fasteners in a single location is to be avoided. Applications where the depth of the driven fastener is critical are typical environments in which the sequential mode is employed.

The other operational mode is termed bottom tripping or "bump firing", and occurs where the operator holds the trigger in the depressed position, and the tool drives a fastener each time the workpiece contacting element is sufficiently depressed against the workpiece. In this mode, fastener driving occurs regardless of whether the trigger or the workpiece contact element is depressed first. Because the sequence described above in relation to the sequential mode need not be repeated for each fastener, the bottom tripping mode of operation is preferred when speed, not accuracy is needed to complete the job. Suitable examples of situations where bottom tripping is employed are rough residential framing and roofing, pallet construction or shipping crate construction.

One problem with conventional trigger assemblies for this type of tool is that the operator either cannot remember, or cannot easily tell by looking which tool mode has been selected. In the event the tool is in the bottom tripping mode, and the operator thinks it is in sequential mode, the result may be the inadvertent driving of a fastener into a workpiece, or even when the tool is bumped against another object during transport, since many operators carry the tools with the trigger depressed or squeezed.

A prior approach to this problem is disclosed in U.S. Pat. No. 6,116,488, incorporated by reference, which discloses a trigger assembly having a plate-like stop piece which pivots relative to the trigger and engages the workpiece contact element to provide a hard surface for depressing the control valve. To alternate between the sequential and bottom tripping modes, the pivot point of the stop piece is movable relative to the trigger. One problem of the assembly described in the '488 patent is that when not engaged for driving a fastener, the stop piece moves freely relative to the trigger. Thus, in some cases, and especially when the tool is inverted or used on its side, the stop piece will not be in proper operational position. This is a significant drawback when the user needs to work overhead, as in ceiling construction.

Thus, a first object of the present invention is to provide an improved trigger assembly for a powered fastener tool in which the tool can be used when inverted.

Another object of the present invention is to provide an improved trigger assembly for a powered fastener-driving tool in which the mechanism for converting between sequential and bottom tripping modes is performed with a reduced number of components to reduce manufacturing and assembly costs.

Still another object of the present invention is to provide an improved trigger assembly for a powered fastener-driving tool in which the operator can readily select between the sequential and bottom tripping modes.

Yet another object of the present invention is to provide an improved trigger assembly for a powered fastener-driving tool which provides an indicator of whether the tool is in the sequential or bottom tripping modes.

BRIEF SUMMARY OF THE INVENTION

The above-identified objects are met or exceeded by the present trigger assembly for use with powered fastener-driving tools, such as powered staplers and nail driving tools. To provide the capability of either sequential or bottom trip operation, the trigger assembly provides an actuator lever which is movable relative to the trigger between a sequential and a bottom trip position. A spring biases the lever against the trigger and holds it in place in the selected position, and also facilitates movement between the two positions.

More specifically, a trigger assembly is provided for a power fastener-driving tool having a housing, a control valve mounted to the tool and a reciprocating workpiece contacting element associated with the housing. The assembly includes a trigger member being pivotally engaged on the housing and having a pair of spaced walls, an actuation lever having a free end and a pivot end pivotally engaged on at least one of the walls, the free end being constructed and arranged for engaging the workpiece contacting element, and a biasing element for biasing the lever and the trigger away from the valve. At least one of the walls is configured for receiving the pivot end and for defining two positions for the lever, a first position which places the free end farther from the workpiece contacting element, and a second position which places the free end closer to the workpiece contacting element. The lever is selectively positionable in either the first position or the second position and is held in the selected position by the biasing element.

DETAILED DESCRIPTION OF THE INVENTION

Figure 1:
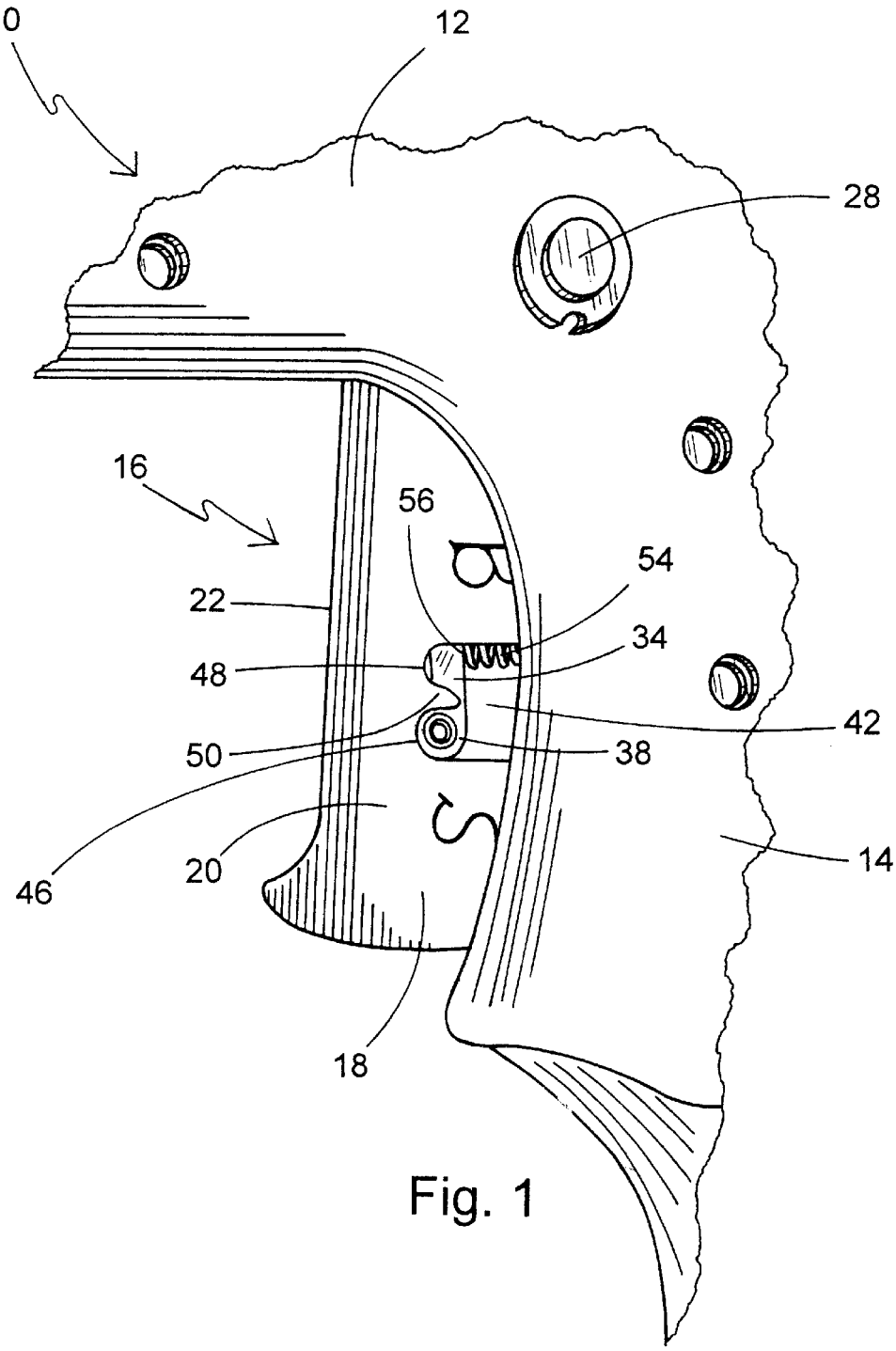
FIG. 1 is a fragmentary side elevational view of a tool of the type suitable for use with the present trigger assembly, showing the present assembly and the mode indicator.

Referring now to FIG. 1, a power fastener-driving tool of the type suitable for use with the present trigger mechanism is partially shown and is generally designated 10. As described above, it is contemplated that the present trigger mechanism may be employed in any type of power fastener-driving tool, including, but not limited to pneumatic, electric, combustion powered and powder activated tools. A suitable tool is described in U.S. Pat. No. 4,629,106, which is incorporated by reference. For the purposes of this application, the typical orientation for this type of tool is with the tool vertically aligned (perpendicularly) above a workpiece. Thus, when directional terms such as "upward, above or below" are employed, it is with reference to this orientation of the tool, with the understanding that the tool can be operated in other orientations.

The tool 10 includes a housing 12 forming a handle portion 14. A trigger assembly, generally designated 16, is pivotally mounted to the housing 12, and features a trigger 18.

Figure 2:
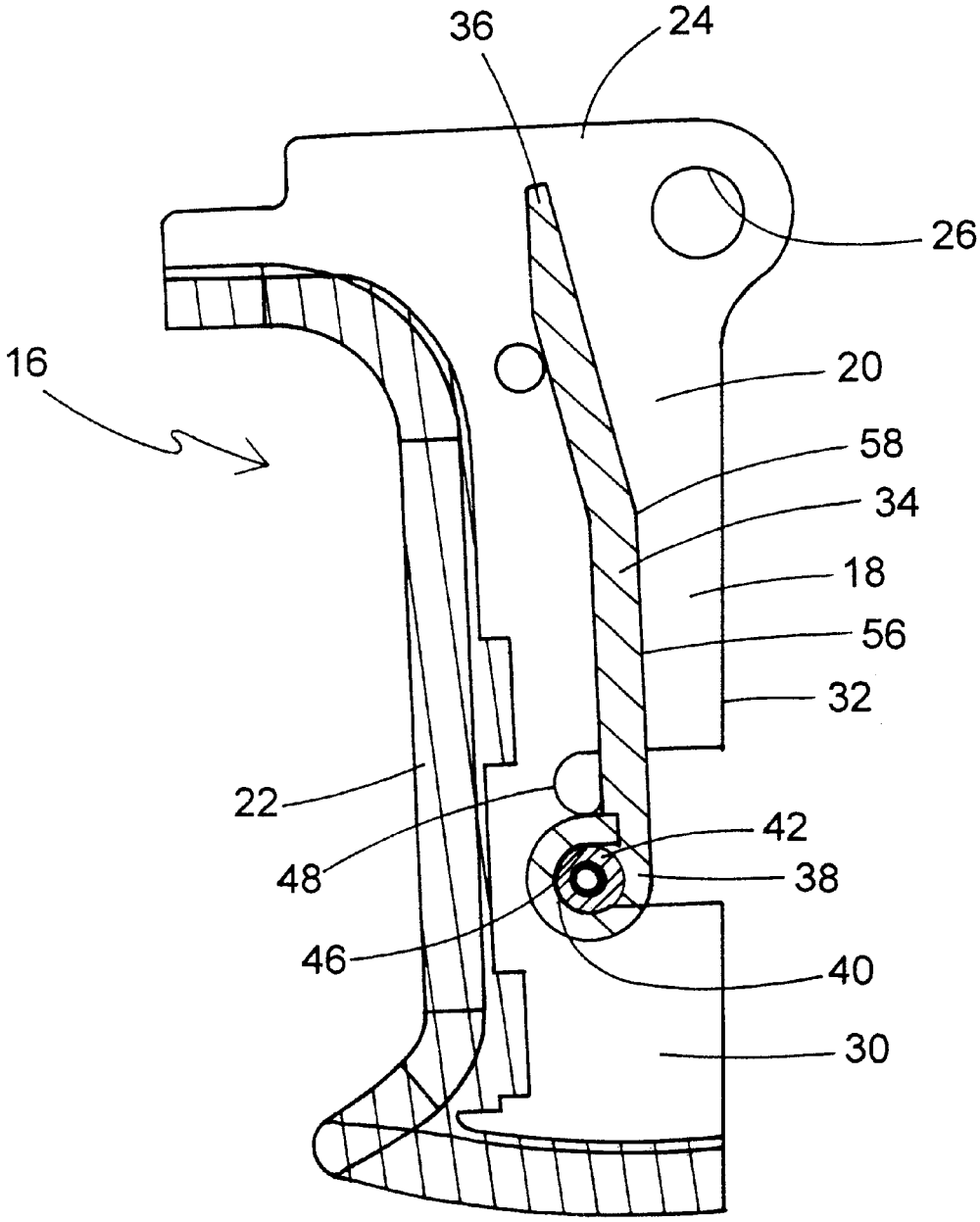
FIG. 2 is a fragmentary vertical section of the present trigger assembly, with portions omitted for clarity.

Referring now to FIGS. 1 and 2, as is typical in the fastener-driving tool art, the trigger 18 is generally "U"-shaped in cross-section, including a pair of spaced apart, generally parallel walls 20 being separated by a finger contact portion 22. An upper end 24 of each of the walls 20 is provided with an eyelet 26 which engages a main pivot pin 28 retained in the housing 12. The walls 20 and the finger contact portion 22 define an inner cavity 30 with an open back end 32. Both the housing 12 and the trigger 18 may be made of any rigid, durable material, including steel, aluminum, plastic or the like.

Disposed within the inner cavity 30 is an actuation lever 34 provided with a preferably generally pointed free end 36 and a pivot end 38 pivotally engaged on at least one of the walls 20. The pivot end 38 is equipped with a transverse throughbore or eyelet 40 into which is inserted a pivot pin 42. While in the preferred embodiment, the actuation lever 34 and the pivot pin 42 are separate components, it is contemplated that they could be integrally formed or fabricated, as long as the pivot pin extends transversely past side edges of the lever 34. In the preferred embodiment, the actuation lever 34 has a width less than the width of the finger contact portion 22 to allow the lever to pivot freely within the inner cavity 30. It is also preferred that the pivot pin 42 is hollow or at least has recessed ends which are configured to slidingly accommodate a nail or other pointed object.

An important feature of the present trigger assembly 16 is that at least one, and preferably both of the walls 20 are configured for receiving the pivot end 38 and for defining two positions for the lever 34. More specifically, the trigger assembly 16 provides a first position, generally designated "S" for sequential, which places the free end 36 farther from a workpiece contacting element, generally designated 44 (best seen in FIG. 3), and a second position, generally designated "B" for bottom tripping, which places the free end closer to the workpiece contacting element.

In the preferred embodiment, at least two notch formations or notches 46, 48 in at least one, and preferably both of the walls 20, define the first and second positions S, B. The notch formations 46, 48 are preferably arcuate in shape, are dimensioned to accommodate the pivot pin 42, and are separated by a divider 50 (best seen in FIG. 1). As is shown in FIGS. 1 and 2, the divider 50 is generally wedge-shaped for facilitating movement of the pivot end 38 between the first and second positions.

A feature of the present trigger assembly 16 is that the actuation lever 34 is biased toward the trigger 18, and specifically toward the finger contact portion 22 and away from a control valve 52 (shown hidden) mounted to the tool 10. As is well known in such fastener-driving tools, actuation of the control valve 52 initiates a "firing" of the tool, or a driving of a fastener, by electricity, combustion pneumatic pressure or equivalent power source. In the present trigger assembly 16, the biasing force is provided by a biasing element which preferably takes the form of a coiled spring 54 which impacts the housing 12 at one end and a spring surface 56 of the actuator lever 34 at the opposite end. Most preferably, the coiled spring 54 is configured to circumscribe the control valve 52, which helps locate the spring in the tool 10. The spring 54 is constructed and arranged to bias the actuation lever against the trigger 18, and so that the pivot pin 42 is pressed against the notch formations 46, 48.

The actuation lever 34 is generally planar, but it is contemplated that, depending on the application and the configuration of the particular tool 10, the lever may be provided or formed with a bend or jog 58 between the free and pivot ends 36, 38. In some applications, the bend 58 may be configured to more positively engage a trigger end 60 of the workpiece contacting element 44.

Figure 3:
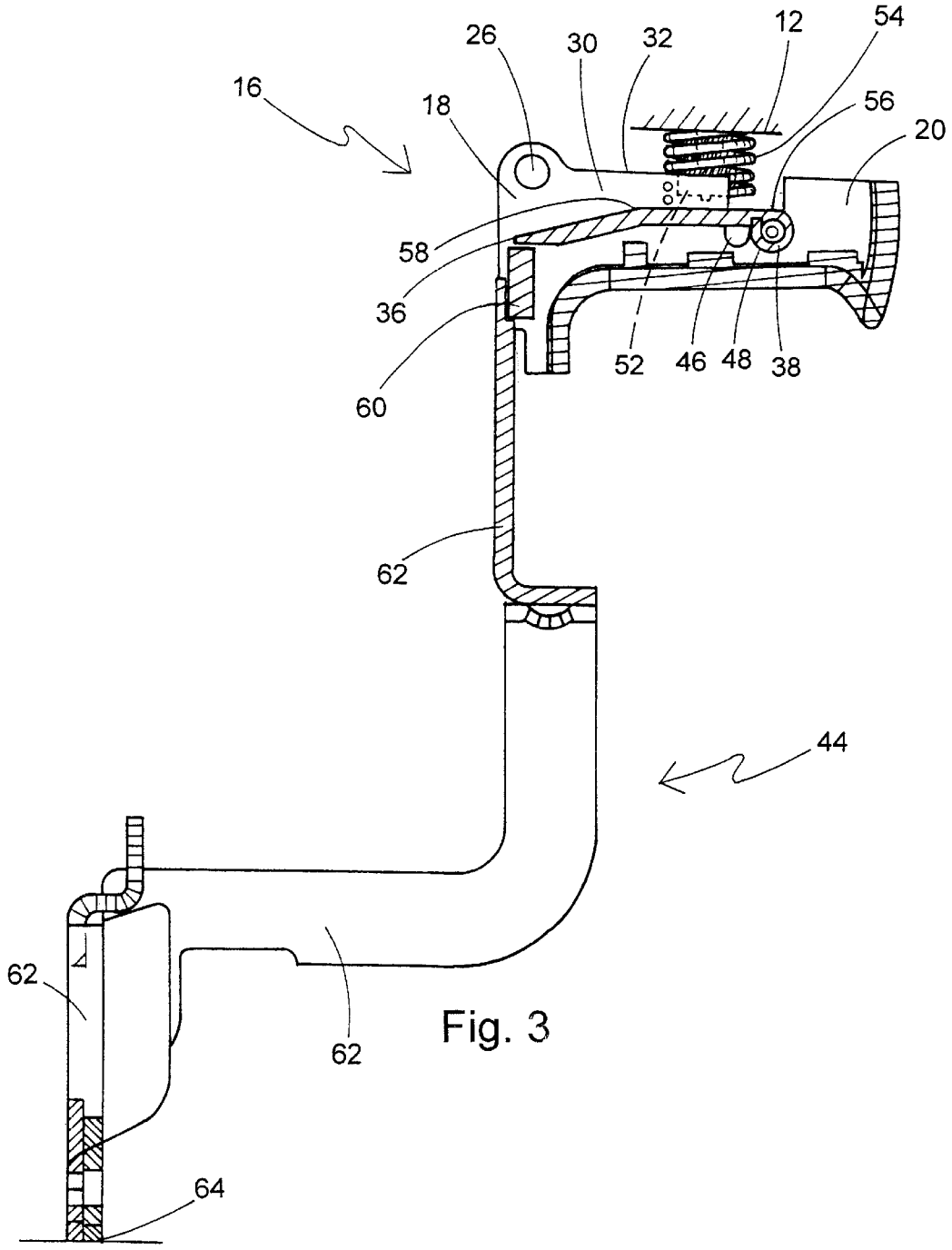
FIG. 3 is a schematic sectional view of the present trigger assembly in the sequential mode prior to firing.

Referring now to FIG. 3, in general, workpiece contact elements 44 are provided in a wide variety of configurations, and often include several link arms 62 for transferring movement from an actual workpiece contacting surface 64 to the trigger 18. As is typical in powered fastener tools, the workpiece contacting element 44 reciprocates between a normal or extended position, and a depressed or retracted position, in which the workpiece contacting element 44 is displaced vertically as the user of the tool 10 presses the tool against the workpiece.

Referring now to FIGS. 3–6, the sequential operation of the present trigger assembly 16 will be described. A basic operational requirement of the tool 10 is that firing or driving of a fastener can only occur when the free end 36 of the actuation lever 34 is pressed in a direction away from the finger contact portion 22 by the trigger end 60. This is because the actual firing of the tool 10 occurs when the actuation lever 34 engages the control valve 52. A feature of the present trigger assembly 16 is that the user can readily select the mode between sequential (S) and bottom-tripped (B) by inserting a pointed object such as a nail, and moving the pivot pin 42 into a designated one of the notch formations 46, 48. The biasing force of the spring 54 holds the actuation lever in the selected notch formation 46, 48. An indicator is provided to the trigger 18 to show the user which notch formation 46, 48 corresponds to which mode. In the preferred embodiment, the indicator takes the form of the letters 'B' and 'S' printed on or formed in the trigger 18, or otherwise fixed to the trigger as is known in the art.

Referring now to FIG. 3, in the S or sequence position, without contact between the trigger end 60 and the actuation lever 34, there will be no firing. In the proper sequence, as the workpiece contacting element 44 moves toward the trigger 18 and the actuation lever 34, as when the user presses the tool 10 against the workpiece, engagement will occur to permit actuation of the control valve 52 by the lever. In the S position, the trigger 18 has to be released or in an unactuated position before the workpiece contacting element 44 is actuated.

Figure 4:
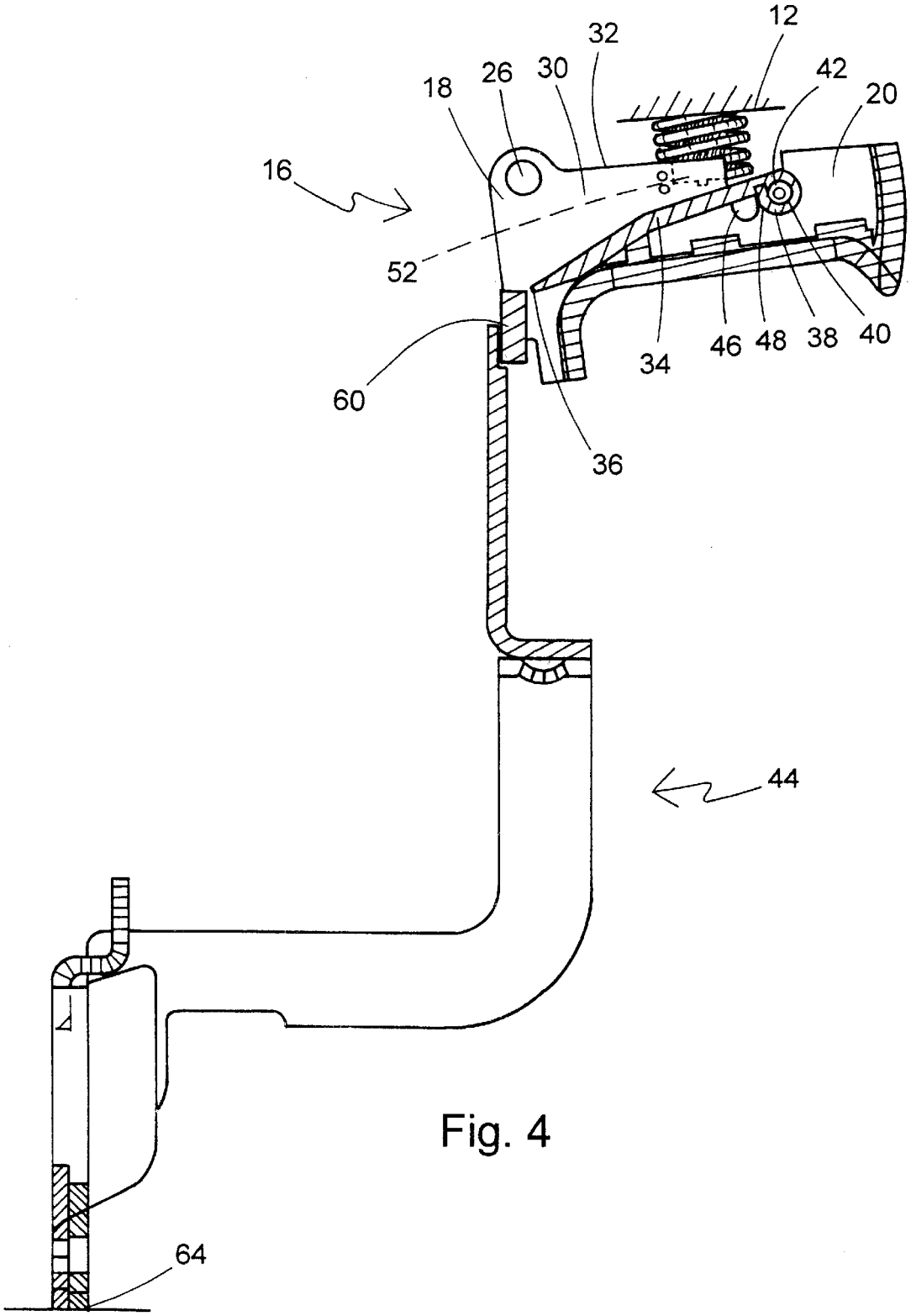
FIG. 4 is a schematic sectional view of the apparatus of FIG. 3 shown when the trigger is depressed before the workpiece contacting element is depressed.

Referring now to FIG. 4, in the S position or mode, if the trigger 18 is actuated or pulled before the workpiece contacting element 44 is in the proper position to provide the trigger end 60 as a support for the actuation lever 34, the free end 36 will fail to engage the trigger end, and firing will not be possible. This feature is provided to prevent the firing of the tool 10 when the workpiece contacting element 44 is not depressed against the workpiece.

Figure 5:
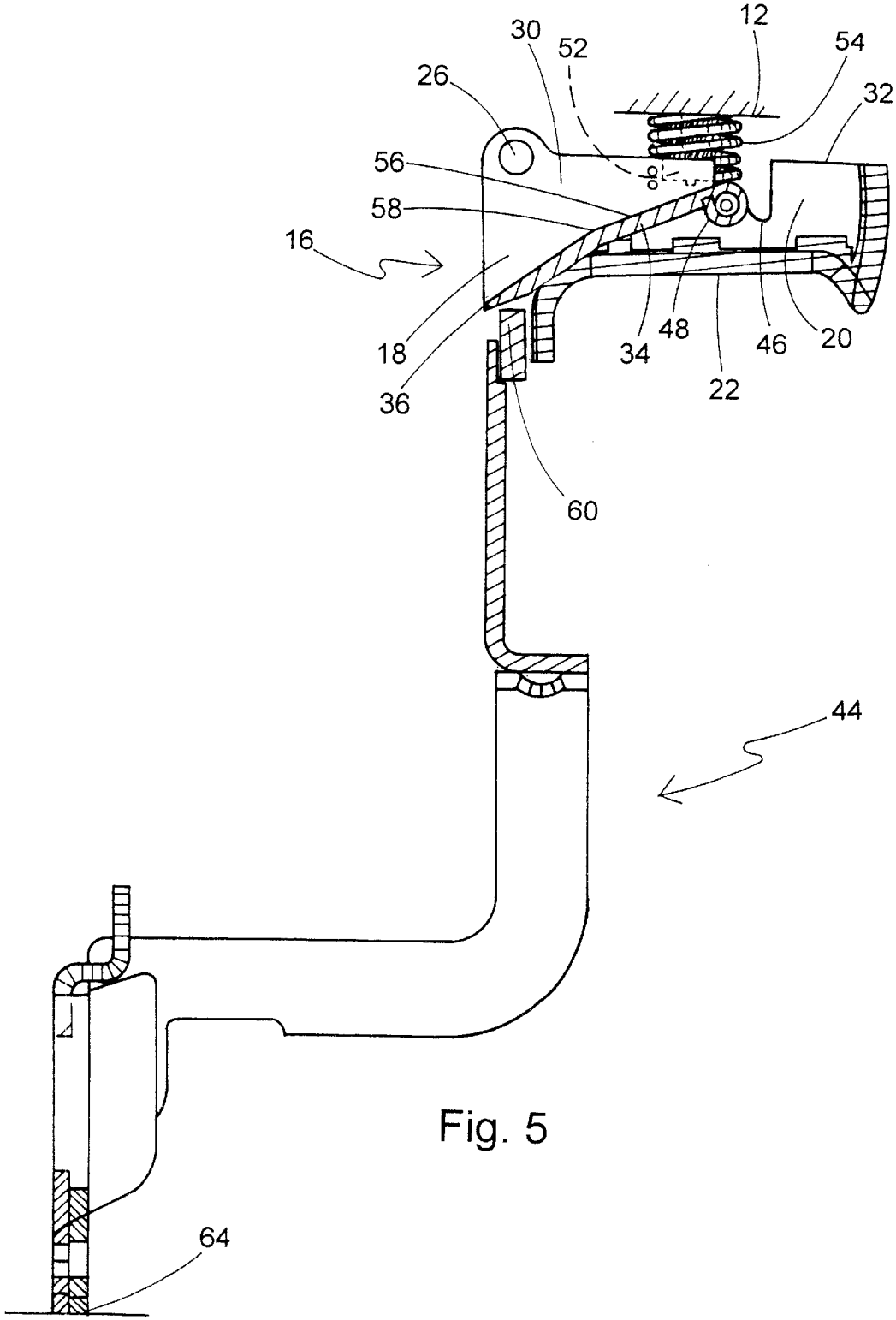
FIG. 5 is a schematic sectional view of the present trigger assembly in the bottom tripping mode prior to firing.
Figure 6:
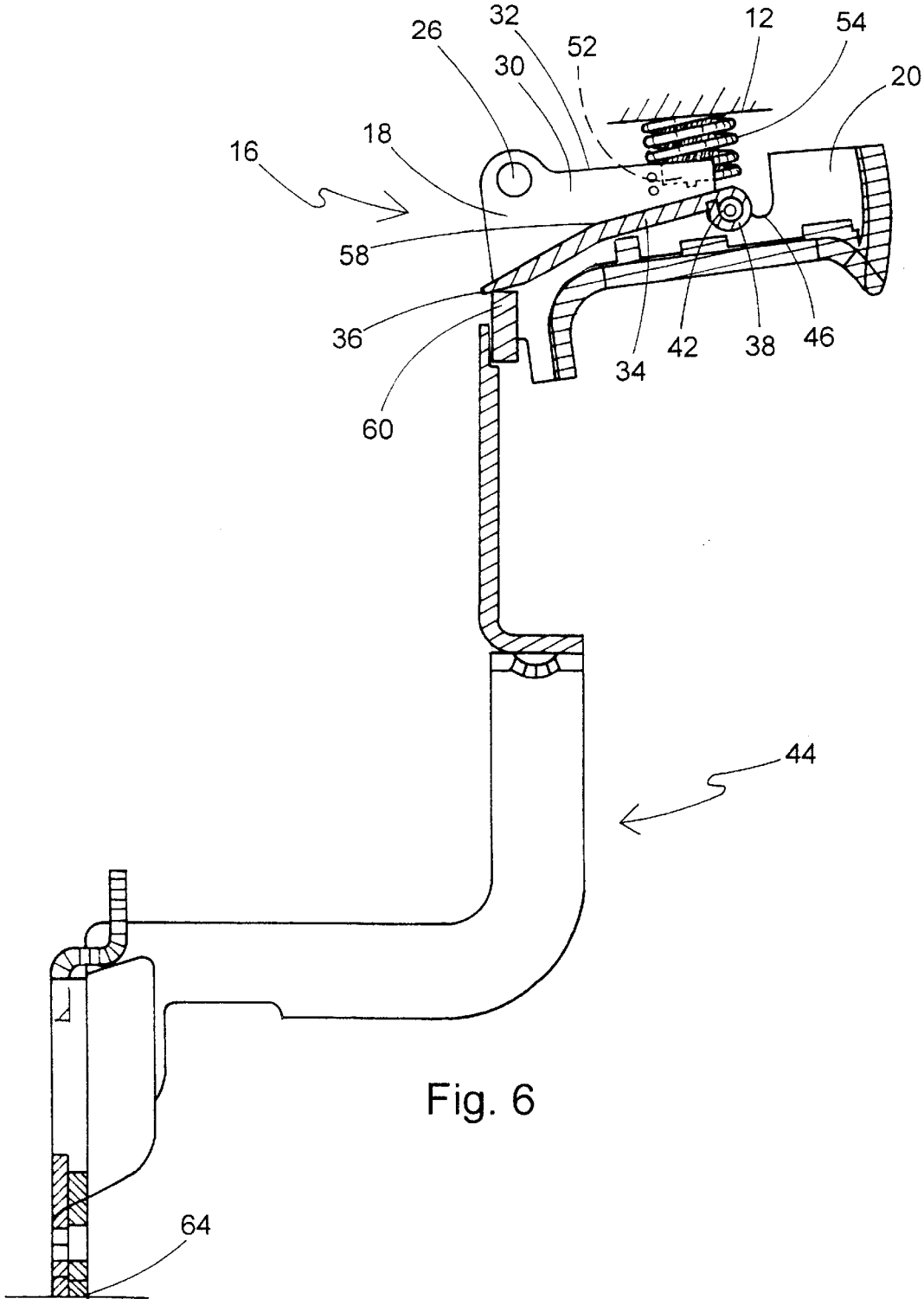
FIG. 6 is a schematic sectional view of the apparatus of FIG. 5 shown when the trigger is depressed and the workpiece contacting element is in the process of being depressed against the workpiece.

Referring now to FIG. 5, when the user selects the bottom-trip or B mode, the actuation lever 34 is moved closer to the workpiece contacting element 44 so that even if the trigger 18 is pulled before the workpiece contacting element 44 is depressed, the free end 36 will still engage the trigger end 60. In this manner, bottom-trip firing can be implemented by the user keeping the trigger 18 depressed or pulled between firings. Then, each time the tool 10 is placed against the workpiece and depressed, the workpiece contacting element 44 will move toward the actuation lever 34 until engagement is made between the trigger end 60 and the free end 36, and the control valve 52 is actuated. Assisted by the recoil from each fastener firing, the tool 10 is easily raised from the location of the driven fastener and placed in a new firing position. In the bottom-tripping mode, the firing cycle is thus shortened, allowing the user to drive fasteners at an increased rate.

Thus, it will be seen that the present trigger assembly provides an improved mechanism for selectively operating a power fastener-driving tool between sequential and bottom-tripping modes. By placing a biasing force on the actuation lever, the tool can be operated on its side or inverted, as when a user is working overhead. Also, the trigger incorporates an indicator which notifies the user which mode (sequential or bottom-firing) the tool is in. To select the mode of operation, the user merely inserts a pointed object into the hollow pivot pin 42 of the actuation lever 34, and moves the lever into the selected notch formation 46, 48 against the biasing force of the spring 54.

While specific embodiments of the selectable trigger of the present invention have been shown and described, it will be appreciated by those skilled in the art that changes and modifications may be made thereto without departing from the invention in its broader aspects and as set forth in the following claims.

What is claimed is:

1. A trigger assembly for a power fastener-driving tool having a housing, a control valve mounted to the tool and a reciprocating workpiece contacting element associated with the housing, comprising:

a trigger member being pivotally engaged on the housing and having a pair of spaced walls;

an actuation lever having a free end and a pivot end pivotally engaged on at least one of said walls, said free end being constructed and arranged for engaging the workpiece contacting element;

a biasing element for biasing said lever and said trigger away from the valve;

at least one of said walls being provided with a pair of spaced notches configured for receiving said pivot end and for defining two positions for said lever, a first position which places said free end farther from the workpiece contacting element, and a second position which places said free end closer to the workpiece contacting element, said notch formations being generally arcuate in shape and being separated by a divider; and said lever being selectively positionable in one of said first position and said second position and being held in said selected position by said biasing element.

2. The assembly of claim 1 wherein said divider is generally wedge-shaped for facilitating movement of said pivot end between said first and second positions.

3. The assembly of claim 1 wherein said biasing element is configured for biasing said lever into engagement with said trigger.

4. The assembly of claim 1 wherein said trigger is generally U-shaped in cross-section, with said spaced walls being separated by a finger contact portion.

5. The assembly of claim 1 wherein said trigger is provided with an indicator for indicating in which of said first position and said second position said lever is positioned.

6. The assembly of claim 1 wherein said first position designates sequential operation of the fastener tool, and said second position designates bottom trip operation of the fastener tool.

7. The assembly of claim 1 further including a pivot pin for connecting said actuator lever with said wall.

8. The assembly of claim 7 wherein said pivot pin is configured for moving said lever between said first and second positions.

9. The assembly of claim 8 wherein said pivot pin is hollow.

10. A trigger assembly for a power fastener-driving tool having a housing, a control valve mounted to the tool and a reciprocating workpiece contacting element associated with the housing, comprising:

a trigger member being pivotally engaged on the housing and having a pair of spaced walls;

an actuation lever having a free end and a pivot end pivotally engaged on at least one of said walls, said free end being constructed and arranged for engaging an end of the workpiece contacting element;

a hollow pivot pin for connecting said actuator lever with said wall;

a biasing element for biasing said lever and said trigger away from the valve;

at least one of said walls being provided with a pair of spaced notches configured for receiving said pivot end and for defining two positions for said lever, a first position which places said free end farther from the workpiece contacting element, and a second position which places said free end closer to the workpiece contacting element, said pivot pin being configured for moving said lever between said first and second positions; and said lever being selectively positionable in one of said first position and said second position and being held in said selected position by said biasing element.

11. A trigger assembly for a power fastener-driving tool having a housing, a control valve mounted to the tool and a reciprocating workpiece contacting element associated with the housing, comprising:

a trigger member being pivotally engaged on the housing and having a pair of spaced walls;

an actuation lever having a free end and a pivot end pivotally engaged on at least one of said walls, said free end being constructed and arranged for engaging the workpiece contacting element;

at least one of said walls being configured for receiving said pivot end and for defining two positions for said lever, a first position which places said free end farther from the workpiece contacting element, and a second position which places said free end closer to the workpiece contacting element; and at least one indicator on said trigger for indicating in which of said first position and said second position said pivot end is positioned.

12. The trigger assembly of claim 11 further including a biasing element for biasing said lever and said trigger away from the valve, and said lever being selectively positionable in one of said first position and said second position and being held in said selected position by said biasing element.

* * * * *